US006917915B2

(12) United States Patent
Du et al.

(10) Patent No.: US 6,917,915 B2
(45) Date of Patent: Jul. 12, 2005

(54) MEMORY SHARING SCHEME IN AUDIO POST-PROCESSING

(75) Inventors: Robert Weixiu Du, Danville, CA (US); Chinping Q. Yang, Cupertino, CA (US)

(73) Assignees: Sony Corporation, Tokyo (JP); Sony Electronics Inc., Park Ridge, NJ (US)

( * ) Notice: Subject to any disclaimer, the term of this patent is extended or adjusted under 35 U.S.C. 154(b) by 742 days.

(21) Appl. No.: 09/867,735

(22) Filed: May 30, 2001

(65) Prior Publication Data

US 2003/0163303 A1 Aug. 28, 2003

(51) Int. Cl.[7] ..... G10L 21/04
(52) U.S. Cl. ..... 704/228; 704/270; 704/500; 711/5
(58) Field of Search ..... 704/228, 270, 704/500–504; 711/5, 11, 170

(56) References Cited

U.S. PATENT DOCUMENTS 5,845,249 A * 12/1998 Malladi et al. ..... 704/270
6,092,046 A * 7/2000 Okuda ..... 704/500

* cited by examiner

*Primary Examiner*—Abul K. Azad
(74) *Attorney, Agent, or Firm*—Wood, Herron & Evans, L.L.P.

(57) ABSTRACT

A method, apparatus and program product facilitates the sharing of memory resources between exclusive audio post-processes. A program identifies post-processing applications that execute at different instances and assigns to them a common memory block. An audio packet arrives at a digital signal processor (DSP). The DSP associates a frame of the packet with a post-process. The DSP buffers the frame to a memory block that corresponds to the post-process. Upon releasing the buffered frame, the DSP prepares the memory block for use with a second post-process and frame.

20 Claims, 4 Drawing Sheets

MEMORY SHARING SCHEME IN AUDIO POST-PROCESSING

FIELD OF THE INVENTION

The present invention relates to sound reproduction systems, and more particularly to an apparatus, method and program product for managing memory resources within an audio playback environment.

BACKGROUND OF THE INVENTION

Efficient memory management is essential to any commercial products performing complex data processing. For instance, entertainment systems rely on memory allocation for audio processing applications. Sound system designers employ such applications to make entertainment systems closer to live entertainment or commercial movie theaters. An initial step toward producing more enveloping and convincing sound was accomplished by increasing the number of sound channels encoded in a single low-rate bitstream. This trend accelerated the advent of data compression techniques that reduce transmission channel bandwidth and the storage space. While encoder design has aimed to result a simpler decoder, the increasing CPU and memory usage is still inevitable for the low bit-rate codecs. Since the memory usage is directly related to the cost of the commercial products, careful management of memory usage is crucial.

One such codec for digital audio, known as AC-3, is used in connection with digital television and audio transmissions, as well as with digital storage media. AC-3 encodes a multiplicity of channels as a single bitstream. More specifically, the AC-3 standard provides for the storage or broadcast of as many as eight channels of audio information.

The standard reduces the amount of data bits required to reproduce high quality audio by capitalizing on how the human ear processes sound. A psycho-acoustic model is utilized in the bit allocation process such that more important audio components get more bits while less perceivable audio components get less not no bits at all. For example, the unimportant audio frequency components can be those located in the frequency domain close to strong audio signals and their contribution to human's perception is masked by their neighbors. This psycho-acoustic model plays a very important role in audio data compression.

Five AC-3 audio channels include wideband audio information, and an additional channel embodies low frequency effects. The channels are paths within the signal that represent Left, Center, Right, Left-Surround, and Right-Surround data, as well as the limited bandwidth low-frequency effect (LFE) channel. AC-3 conveys the channel arrangement in linear pulse code modulated (PCM) audio samples. AC-3 processes an 18 to 22 bit signal over a frequency range from 20 Hz to 20 kHz. The LFE reproduces sound at 20 to 120 Hz.

The audio data is byte-packed into audio substream packets and sampled at rates of 32, 44.1, or 48 kHz. The packets include a linear pulse code modulated (LPCM) block header carrying parameters (e.g. gain, number of channels, bit width, bit rate, compression information, as well as video coordination and frequency identification) used by an audio decoder. Select header blocks include presentation time stamp (PTS) values that indicate the decoding time for an audio frame. The time stamp value is a time reference to a system time clock that was running during the creation or recording of the audio and video data. A similar system time clock is also running during the playback of the audio and video data and the PTS can be used for the synchronization of video and audio presentations.

Following the header block, the audio data packet contains any number of audio frames. The block header 10 is shown in the packet 12 of FIG. 1A along with a block of audio data 14. The format of the audio data is dependent on the bit-width of the frames. FIG. 1B shows how the audio frames in the audio data block may be stored for 16-bit samples. In this example, the 16-bit samples made in a given time instant are stored as left (LW) and right (RW), followed by samples for any other channels (XW). Allowances are made for up to 8 channels, or paths within a given signal.

During the decoding of the audio data, audio samples must normally be decompressed, reconstructed and enhanced in a manner consistent with the source of program material and the capabilities of the sound reproduction system. In some applications, audio data packets may contain up to six channels of raw audio data. Depending on the number of channels the sound reproduction system can reproduce, the system selectively uses the channels of raw audio data to provide a number of channels of audio that may be then stored in an audio first-in, first-out (FIFO) memory. A host, or suitable microprocessor, may read the header block before determining which frames to buffer immediately.

In addition to providing low bit-rate, the multichannel nature of the AC-3 standard allows a single signal to be independently processed by various post-processing algorithms. The post-processes, in turn, augment and facilitate playback. Such techniques include matrixing, center channel equalizing, enhanced surround sound, bass management, as well as other channel transferring techniques. Generally, matrixing achieves system and signal compatibility by electrically mixing two or more sound channels to produce one or more new ones. Because new soundtracks must play transparently on older systems, matrixing ensures that no audible data is lost in dated cinemas and home systems. Conversely, matrixing enables new audio systems to reproduce older audio signals that were recorded outside of AC-3 standards.

Since everyone does not have the equipment needed to take advantage of AC-3 5.1 channel sound, an embodiment of matrixing known as downmixing ensures compatibility with older playback devices. Downmixing is employed when a consumer's sound system lacks the full complement of speakers available to the AC-3 format. For instance, a six channel signal must be downmixed for delivery to a stereo system having only two speakers. For proper audio reproduction in the two speaker system, a decoder must matrix mix the audio signal so that it conforms with the parameters of the dual speaker device. Similarly, should the AC-3 signal be delivered to a mono television, the audio decoder downmixes the six channel signal to a mono signal compatible with the amplifier system of the television. A decoder of the playback device executes the downmixing algorithm and allows playback of AC-3 irrespective of system limitations.

Conversely, where a two channel signal is delivered to a four or six speaker amplifier arrangement, Dolby Prologic techniques are employed to take advantage of the more capable setup. Namely, Prologic permits the extraction of four to six decoded channel from two codified digital input signals. A Prologic decoder buffers and disseminates the channels to left, right and center speakers, as well as to two additional loudspeakers incorporated for surround sound purposes. A four-channel extraction algorithm is generically illustrated in FIG. 2. Based on two digital input streams, referred to as Left_input and Right_input, four fundamental output channels are extracted. The channels are indicated in the figure as Left, Right, Central and Surround. Of note, the Prologic decoder generates the center channel by summing the left and right-had stereo channels and combining identical portions of each signal.

A time delay is applied to the surround channel to make it more distinguishable. The stored delay is on the order of 20 ms, which is still too short to be perceived as an echo. Ordinary stereo-encoded material can often be played back satisfactorily through a Prologic decoder. This is because portions of the sound that are identical in the left and right-hand channels are heard from the center channel. The surround channel will reproduce the sound to which various phase shifts have been applied during recording. Such shifts include sound reflected from the walls of the recording location or processed in the studio by adding reverberation. The goal of Prologic is to simulate three discrete-channel sources, with surround steering normally simulating a broad sense of space around the viewer. A center channel equalizer is used to drive a loudspeaker that is centrally located with respect to the listener. Equalizing algorithms controls add emphasis and smoothing functions to the center channel audio, which often is a speech signal.

Enhanced surround sound is a desirable post-processing technique available in systems having ambient noise producing loudspeakers. Such speakers are arranged behind and on either side of the listener. When decoding surround material, four channels (left/center/right/surround) are reproduced from the input signal. Enhanced surround functions divide a single surround channel into two separate surround channels. For instance, the single surround channel produced by the Prologic application is processed into left and right surround channels. Thus, conducting the enhanced surround sound function complements the preceding Prologic output. The labeling of the channels as left and right surround is largely arbitrary, as the audio content of the two channels is the same. However, enhanced surround sound processing introduces a slight time delay between the channels. This time differential tricks the human ear into believing that two distinct sounds are coming from different areas.

In this manner, enhanced surround sound acts as an all pass filter in the frequency domain that introduces a time delay. The delay between the two channels creates a spatial effect. The ambient noise producing surround speakers are arranged behind and on either side of the listener to further assist in reproducing rear localization, true 360° pans, convincing flyovers and other effects.

Bass management techniques are used to redirect low frequency signal components to speakers that are especially configured to playback bass tones. The low frequency range of the audible spectrum encompasses about 20 Hz to 120 Hz. Such techniques are necessary where damage to small speakers would otherwise result. In addition to ensuring that the low frequency content of a music program is sent to appropriate speakers, bass management allows the listener to accurately select a level of bass according to their own preferences.

Virtual Enhanced Surround (VES) and Digital Cinema Sound (DCS) are post-processing methods used to further manage the surround sound component of an audio signal. Both techniques store, divide and sum aspects of the signal to create an illusion of three-dimensional immersion. Which method is used depends on the configuration of a consumer's speaker system. VES enhances playback when the ambient noise or surround sound portion of the signal is conveyed only in two front speakers. DCS is needed to digitally coordinate the ambient noise where rear surround speakers are used.

VES uses digital filters to process the signal to create an augmented spatial effect with two speakers. Similar to enhanced surround, the VES post-processing technique creates time delay and attenuation. More specifically, the right and left surround channels are repetitively stored, summed and differentiated from each other to create new right and left surround channels. These new surround channels embody the spatial effect sought by the listener.

Similar to VES, DCS stores and otherwise manipulates the surround portion of the signal by summing and differentiating channels. The resultant surround sound channels create an illusion of spatial distortion. However, the newly created left and right surround channels are now transmitted to the rear-oriented speakers. As with the VES algorithm, the DCS applications are executed later in the processing sequence to avoid overflow and signal distortion.

Finally, privacy and space considerations commonly draw listeners to select headphones. Headphones allow listeners to discretely enjoy multichannel sound sources, such as movies, with realistic surround sound. The audio signal is now post-processed so that the nearest stereo sound is simulated in the conventional headphone device. Ideally, the headphone circuitry is optimally configured to reflect any matrixing, surround, or bass effects applied to the signal. As with the above post-processing algorithms, a six channel pulse modulated signal is ultimately played back according to the preferences of the listener.

As discussed above in detail, most post-processing circuitry must buffer portions of the audio signal to achieve its respective effect. Certain algorithms, further interject assorted delays into the processing of an audio signal. For instance, surround sound effects rely on time differentials imputed into signals to create a desired three-dimensional listening experience. Similarly, VES and DCS applications apply delays and attenuation to audio signals.

Such delays conventionally require an audio system to temporarily store, or buffer, select frames of the signal within multiple processors. Circuitry processes other frames of the signal in parallel. After some predetermined period, the stored frames are processed and recombined with other processed frames into an output signal. The preset, buffering period corresponds to the delay required by the surround sound algorithm. Such memory allocation applications may severely tax available memory resources, compromising system performance.

More specifically, memory required for post-processing operations can easily exceed the on-chip memory capacity of a Digital Signal Processor (DSP). Such memory requirements typically necessitate memory external from the program processors. External memory conventionally embodies additional processors connected via an internal bus. These processors and other external resources represent additional design and hardware costs to both developers and consumers. Another disadvantage associated with external memory is the slow access as compared with internal or on-chip memory. The remote configuration of such processors can further introduce undesirable delays into processing applications. These delays may attributable to complex search algorithms required to search memory maps, as well as to longer circuit paths traveled by system signals. In a CPU critical application, the on-chip memory is the first choice for the hardware and software designers. Therefore, there is a significant need for more efficient management of memory resource within an audio playback environment.

SUMMARY OF THE INVENTION

The method, apparatus and program product of the present invention relates to managing memory blocks within an audio playback system. One embodiment identifies audio processes that execute at different instances. A program of the embodiment may allocate a common memory block to the exclusive processes. A first audio frame may then be associated with one of the exclusive processes. Ultimately, the audio frame may be buffered to the common memory block. As such, a second audio frame, associated with a different audio process, may be buffered to the same memory block. The program may further incorporate code designed to reset the memory block prior to receiving the second audio frame. The code may also ensure that the exclusive audio processes, in fact, run at different times. Similarly, all switching between processes may be restricted to frame boundaries, and may require volume parameters to be muted.

The above and other objects and advantages of the present invention shall be made apparent from the accompanying drawings and the description thereof.

BRIEF DESCRIPTION OF THE DRAWING

The accompanying drawings, which are incorporated in and constitute a part of this specification, illustrate embodiments of the invention and, together with a general description of the invention given above, and the detailed description of the embodiments given below, serve to explain the principles of the invention.

DETAILED DESCRIPTION OF THE PREFERRED EMBODIMENTS

The invention relates to a method, apparatus and program product for allocating memory resources within an audio post-processing environment. In an audio playback system, only a subset of processing applications can be used simultaneously. One embodiment capitalizes on the exclusivity of certain post-processes to dynamically share memory block resources.

Generally, an audio packet arrives at a digital signal processor (DSP). The audio DSP tags post-processing applications that execute at different times. A memory manager resident on the DSP may assign such exclusive processes a common memory block. The DSP associates a frame of the packet with a designated post-process. The DSP may then buffer the frame to a memory block having a pointer that corresponds to the post-process. Upon releasing the buffered frame, program protocol may prepare the memory block for use with a second post-process and frame.

Figure 1A:
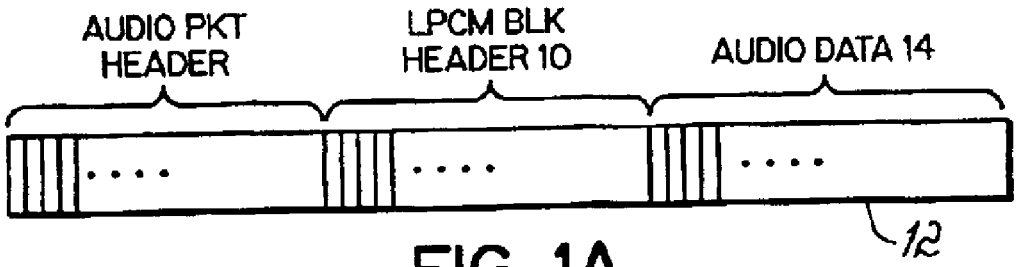
FIGS. 1A and B show examples of an LPCM formatted data packet.
Figure 1B:
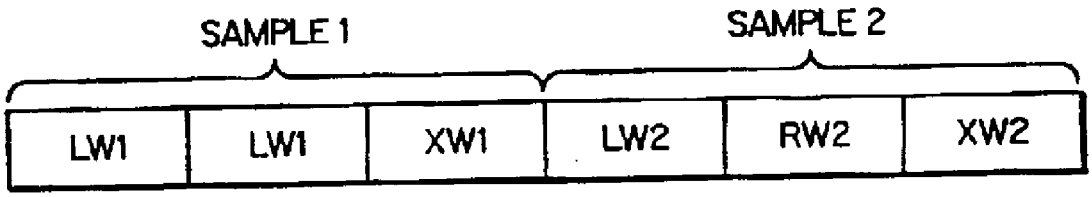
Figure 2:
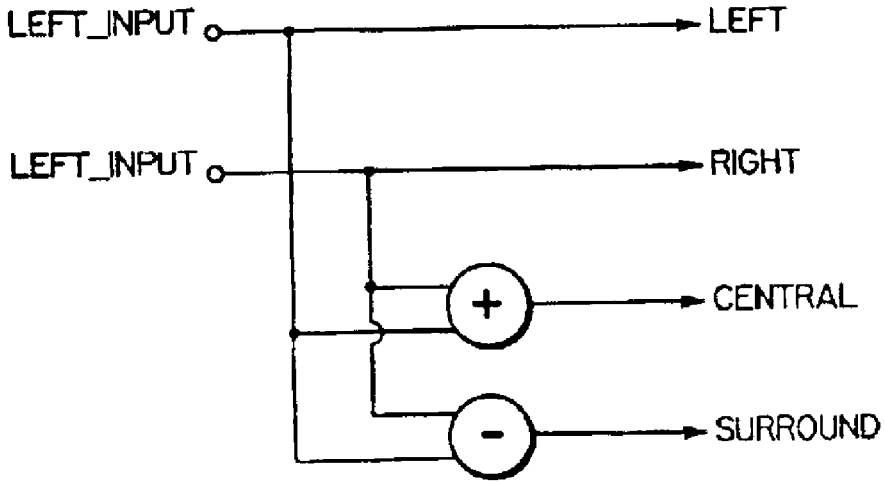
FIG. 2 is a block diagram that generically illustrates a decoding Prologic algorithm.
Figure 3:
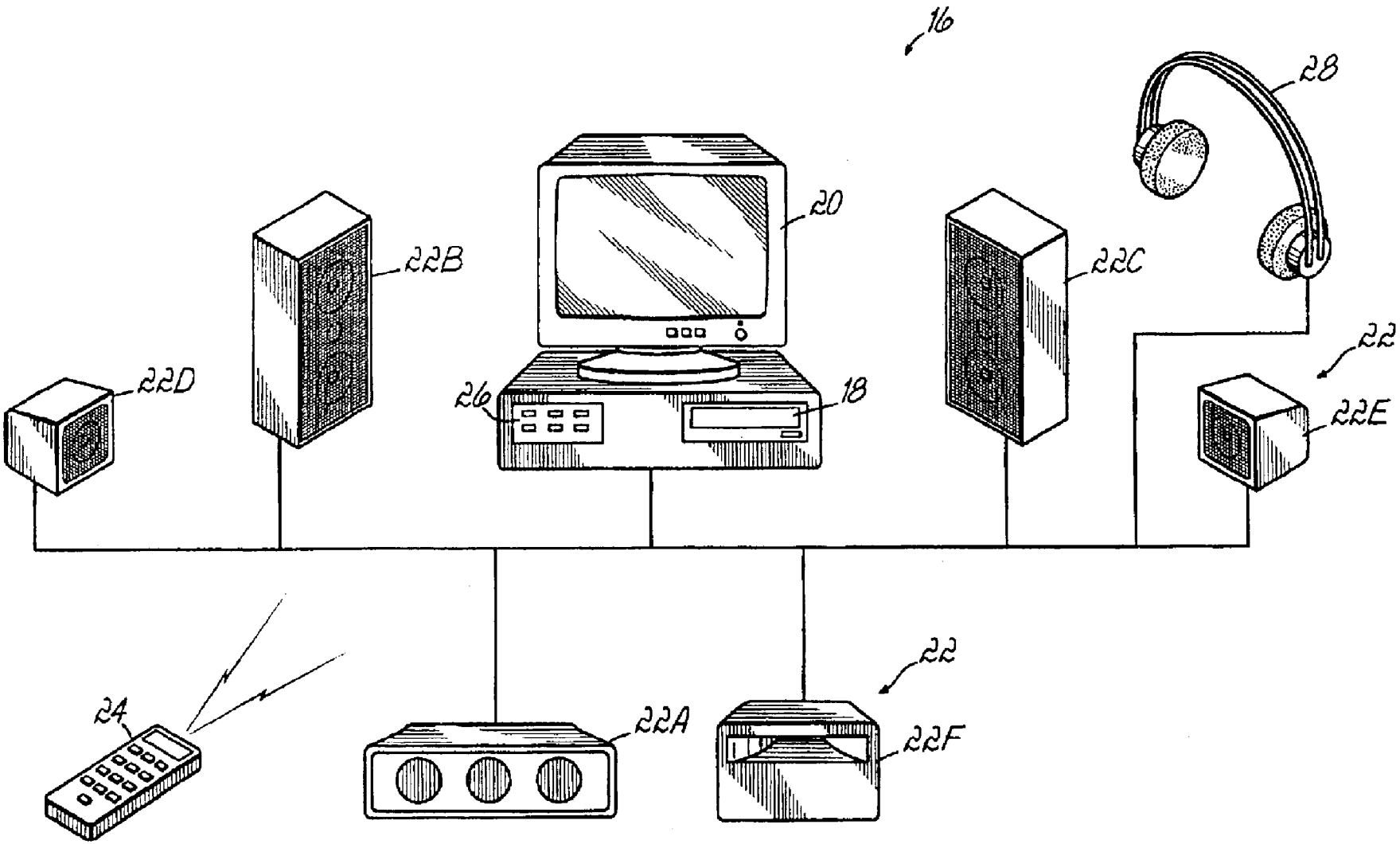
FIG. 3 shows a functional block diagram of a multimedia recording and playback device.

Turning to the figures, FIG. 3 shows an audio and video playback system 16 that is consistent with the principles of the present invention. The system is configured to accommodate the above discussed post-processing applications, as well as embodiments of the memory sharing scheme herein discussed. The exemplary audio system includes a multimedia disc drive 18 that is coupled to both a display monitor 20 and an arrangement of speakers 22. The speakers and amplifiers reproduce and boost the amplitude of audio signals, ideally without affecting their acoustic integrity.

Features of the exemplary playback system 16 may be controlled via a remote control 24.

A player console 26 acts an interface for a listener to input post-processing preferences. Exemplary preferences include enhanced surround sound, bass management, center channel equalizer, VES and DCS. The above effects are selected by any known means including push-buttons, dials, voice recognition or computer pull-down menus. The disposition of speakers, discussed in greater detail below, is likewise indicated at the player console 26.

In one application, the playback system 16 reads compressed bitstreams from a disc in drive 18. The drive 18 is configured to accept a variety of optically readable disks For example, audio compact disks, CD-ROMs, DVD disks, and DVD-RAM disks may be processed. The system 16 converts the multimedia bitstreams into audio and video signals. The video signal is presented on the display monitor 20, which could embody televisions, computer monitors, LCD/LED flat panel displays, and projection systems.

The audio signals are sent to the speaker set 22. The audio signal comprises five full bandwidth channels representing Left, Center, Right, Left-Surround, and Right-Surround; plus a limited bandwidth low-frequency effect channel. The system 16 includes an audio processor arrangement 17 (FIG. 5) configured to post-process the input signal. Exemplary components of such an arrangement may incorporate a decoder, multiple DSP's, as well as other microprocessors. The channels are parsed-out to corresponding speakers, depending upon the listener preferences and speaker availability input to the player console 26. Preferences and settings are saved or re-accomplished at the discretion of the listener. In one embodiment of the invention, the system runs a diagnostic program to determine the speaker configuration of the system.

The speaker set 22 may exist in various configurations. A single center speaker 22A may be provided. Alternatively, a pair of left and right speakers 22B, 22C may be used alone or in conjunction with the center speaker 22A. Four speakers 22B, 22A, 22C, 22E may be positioned in a left, center, right, surround configuration. Alternatively, five speakers 22D, 22B, 22A, 22C, 22E may be provided in a left surround, left, center, right, and right surround configuration. Left and right surround speakers are typically small speakers that are positioned towards the sides or rear in a surround sound playback system. The surround speakers 22D, 22E handle the decoded, extracted, or synthesized ambience signals manipulated during enhanced surround and DCS processes.

Additionally, a low-frequency effect speaker 22F may be employed in conjunction with any of the above configurations. The LFE speaker 22F unit is designed to handle bass ranges. Some speaker enclosures contain multiple LFE speakers to increase bass power. A headphone set 28 is additionally incorporated as a component of the sound playback system.

Alternative speaker arrangements incorporate an individual speaker unit (driver) designed to handle the treble range, such as a tweeter. Another speaker system compatible with the invention uses separate drivers for the high and low frequencies; the midrange frequencies are split between them. Some such two-way systems incorporate a non-powered passive radiator to augment the deep bass. Similarly, a three-way loudspeaker system that uses separate drivers for the high, midrange, and low effect frequencies can be utilized in accordance with the principles of the invention.

Figure 4:
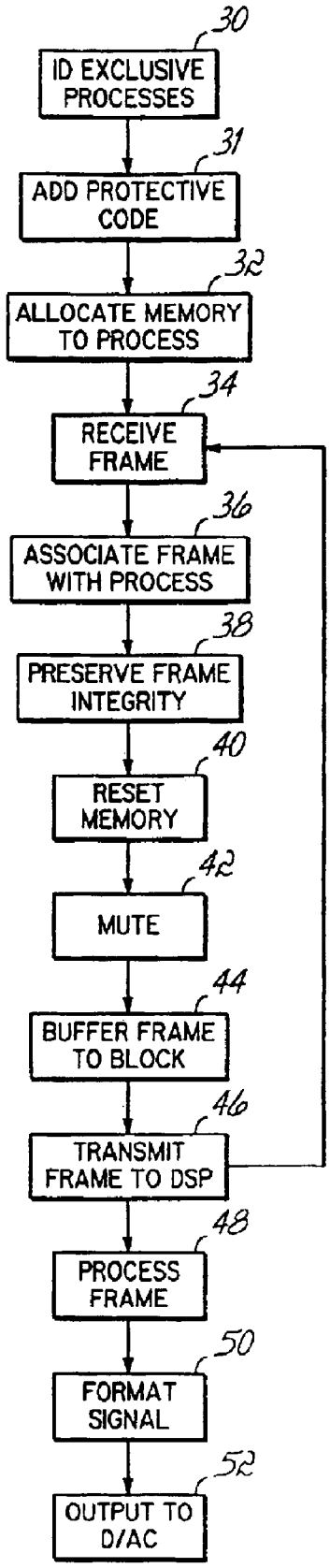
FIG. 4 illustrates a flowchart for a memory sequence suited for execution within the playback environment of FIG. 3.

FIG. 4 is a flowchart depicting a memory sharing sequence suitable for execution within the hardware environment of FIG. 3. At block 30, a memory manager program of the invention identifies exclusive post-processes. For instance, the memory manager may be programmed to recognize that a headphone-3D algorithm will not execute when a two-channel operation is invoked. Thus, when a two-channel operation is indicated by a header block or user input, memory access for the headphone process may be disabled. Similarly, an audio DSP may recognize that an audio system does not require a VES function when playback calls for a DCS application. Other exemplary exclusive processes may include downmixing and prologic algorithms, as well as headphone and equalizer functions.

The program may further incorporate protective code at block 31 to ensure the exclusivity of certain processes. For example, code protections embedded into the program may prevent designated processes from running in parallel. Such programmed safeguards may eliminate instances where two processes simultaneously request a common memory block. Such a scenario could result in inadequate memory, internal error messages and sound distortion.

At block 32, the memory manager program may assign memory resources relative to applicable post-processing techniques. The program may allocate memory according to a common scheme or bit map of memory blocks. The bit map accounts for the instance and address of memory block(s) allocated by the DSP to a particular post-process. Thus, the map reflects block identifiers assigned by the DSP to memory resources. Suitable identifiers may comprise a handle or a pointer. A handle is an identifier of an allocated block of memory that acts as a pointer to a pointer. The block identifier may be logically linked to pointers associated with post-processes. In this manner, the memory manager program may associate a single block of memory with one or more exclusive processes.

At block 34, an audio DSP of the playback system processes an incoming digital packet and embedded audio frames. At block 36, the memory management program associates a first audio frame with a designated post-process. A user or developer post-process preference may be encoded into the header block of the digital audio packet. For instance, program assignments designating applicable post-processes may be fixed by developers upon production. As discussed above, the process designation may be derived from user input at the player console of FIG. 3. Thus, the program may use the input to tailor a memory sharing application to the specific listening preferences of the user. In any case, the designated post-process may access an appropriate memory block using a block identifier. More particularly, when a requesting program requests a block of memory, the memory manager allocates a block of memory to a requesting post-process. The manager then returns to the requesting program a block identifier associated with the allocated block.

The post-process associated with the first frame may be the same algorithm applied to a previously processed frame. Alternatively, the audio DSP of the system may associate the frame with a second post-process. As such, the memory manager program may incorporate a switching protocol to ensure a smooth transition between post-processing applications. Absent such protocol, the program may instigate noise and other disturbances inherent to a switching process. Unchecked, the disturbances can become audible and otherwise disruptive to the listener.

One aspect of an exemplary protocol may regard timing issues. Particularly, an application may relate to switching operations between different post-processes. The integrity of audio playback may be severely disrupted if a processing switch should occur in the middle of a frame. Frame data can be lost and corrupted beyond recognition if precautions are not taken to limit switch operations to the beginning and ending of frames. Therefore, program protocol at block 38 may ensure that switching operations only occur at frame boundaries. One method for accomplishing this involves coordinating DSP sequences with the system time stamp clock and packet PTS information.

At block 40, the protocol may call for the program to reset the memory of a block prior to the arrival of a new frame. Should an audio frame arrive at a memory block that contains data from a prior application, the storage operation may distort the frame, resulting in noise. To avoid such distortion, the program may crudely erase, or "zero," stored data. The program may also employ sophisticated garbage collection schemes to free allocated memory. At block 42, the program may further guard against noise and other audio glitches by causing the DSP to mute certain volume parameters. For instance, the DSP may set a volume control to some minimum level, or decrease the gain corresponding to a switching period. Such manipulation of the gain may be gradual and coordinated with other DSP processes to achieve an inaudible setting, to include a buffer clearing operation. Low-pass filters and/or a decoder configured to reduce noise may additionally be employed at block 42.

At block 44, the program buffers the frame to the memory block(s) designated at block 36. The DSP may store the frame for a period corresponding to a time differential preset by an applicable post-process. Coincident with the expiration of the period, the program may transmit 46 a signal to the audio DSP. The signal may then initiate the processing of the frame. The DSP may process the frame at block 48 according to a post-processing program resident on the audio DSP or another suitable microprocessor. More particularly, the program instructions may digitally manipulate the frame in a manner consistent with a designated post-process, such as a headphone-3D or VES algorithm. As discussed above, other exemplary processing algorithms applied to a frame prior to recombination within an output signal may include matrixing, dividing/summing and balancing operations.

The program protocol of one embodiment may call for the audio DSP to format the recombinant signal at block 50 in accordance with instructions resident on the packet header block. Such formatting may ensure that the resultant audio signal is compatible with IEC958, S/PDIF, AES/EBU, or other audio format standards. Formatting may enable the embodiment to communicate the processed audio data to different playback devices. Audio standards allow the signal to convey tailored bandwidths, coding, datastreams and bitrates as required by varying processing systems and applications.

The DSP may output the formatted signal at block 52 to a digital-to-analog (D/A) converter. The D/A converter further multiplexes and formats the output into an audio signal suited to a particular playback application. Another memory sharing sequence may be initiated at block 34 with the audio system receiving and associating a second audio frame.

Figure 5:
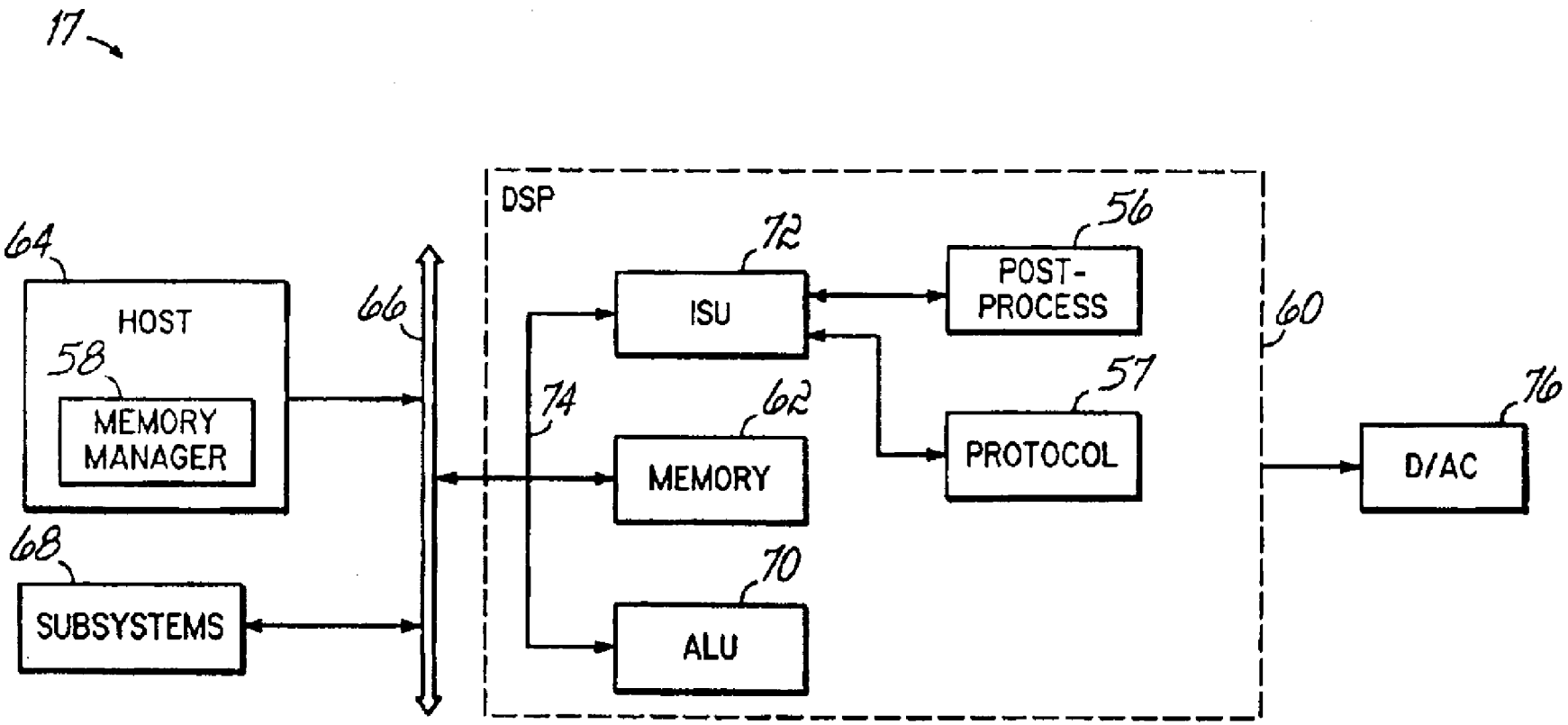
FIG. 5 shows a block diagram of a processor system of FIG. 3.

The block diagram of FIG. 5 shows one embodiment of the audio processor arrangement 17 for the multimedia recording and playback device of FIG. 3. FIG. 5 further illustrates the relationship between a requesting post-process 56 and memory manager program 58, as well as their interaction with DSP memory resources 62. Generally, the processor arrangement 17 facilitates the dynamic management of DSP memory. Requesting post-processes 56 resident on the DSP 60, or on another suitable microprocessor, rely on memory blocks 62 for the temporary storage of audio frames. A memory manager program 58 responds to service requests by allocating common memory block resources as between exclusive post-processes 56.

Turning more particularly to FIG. 5, the exemplary audio processor arrangement 17 includes a digital signal processor (DSP) 60, a host microprocessor 64 and an internal transfer bus 66 for connecting the DSP 60 to the host 64. The bus 66 also connects other subsystems 68 to both the host 64 and processor 60. As is conventional, the DSP 60 may include an arithmetic-logic unit (ALU) 70, an instruction storage unit (ISU) 72, a cache of memory blocks 62, as well as other well-known and conventional components (not shown). A processor data bus 74 connects all DSP components to each other and to the internal transfer bus 66.

The host 64 may receive, maintain and transmit audio data, programs and other instructions required by the DSP 60. Such data and instructions may be initially loaded into the main memory of the host 64 by card readers, disk units, or other peripheral devices that might be found in the other subsystems 68. The host 64 may communicate the resident data and instructions to the DSP 60 over an internal transfer bus 66.

In one embodiment, a memory manager 58 program resides on the host processor 64. The memory manger 58 allocates blocks of memory for the temporary storage of audio data. The program 58 shares memory block resources of the DSP 60 as between post-processes 56 that execute at different instances. In this manner, the memory manager program 58 dynamically manages blocks of memory. Dynamic memory management refers to the process by which blocks of memory are allocated temporarily for a specific purpose and then freed when no longer needed for that purpose.

More particularly, the memory manager program 58 recognizes exclusive post-processes. A protocol program 57 accessible through the ISU 72 may provide coded protections to prevent designated post-processes from running simultaneously, resulting in program errors and sound distortion. The manager program 58 may then assign memory according to applicable post-processing techniques. The program 58 may allocate memory according to a common scheme or bit map of memory blocks 62. The bit map tracks the availability and relationship of memory blocks 62 relative to the identified post-processes. Thus, the memory manager program 58 may logically link a single block of memory with one or more exclusive processes.

For instance, when a requesting post-process requires a block of memory, the process sends a request to the ALU 70, which accesses the memory manager 58 via the host 64, or in an alternative embodiment, the ISU 72. For applications using fixed size blocks, blocks are typically marked as allocated in a bit map. A running pointer or index may identify an appropriate and available block within the bit map. When a block is requested, the pointer or index may be updated by executing a search algorithm to locate the appropriate block. Bit maps are typically large, containing thousands of memory blocks.

Upon receiving a request from a post-processing program 56, the memory manager 58 may request a block of free memory having a certain size, use it, and later request that the block be freed. Free blocks may be made available for reallocation for other functions. In this manner, the memory manager allocates blocks of memory within the DSP according to the needs of a requesting program 56.

The DSP 60 processes the audio frames of an incoming digital packet. The memory management program 58 associates a first audio frame with a post-process 56 derived from the header block of the audio packet. A post-process 56 may access a designated memory block 62 using a block identifier. The memory manager 58 may return a block identifier to the requesting program after allocating the memory block.

The protocol program 57 may ensure that switching operations between memory allocations only occur at frame boundaries by coordinating the system time clock and PTS information. The protocol program 57 may further reset the memory of a block prior to the arrival of a new frame. This "zeroing" of stored data avoids distortive effects. The protocol program 57 may additionally guard against noise and other audio glitches by instructing the ALU 70 to mute amplitude parameters. Low-pass filters may additionally reduce occurrences of noise.

The memory manager 58 may buffer the first audio frame to the designated memory block(s). The DSP 60 may then store the frame for a period as required by the applicable post-process program 56. The memory manager 58 may transmit an instruction to the ALU 70 upon the expiration of the period, initiating further post-processing of the frame.

In response to each instruction from the memory manager 58, the ISU 72 may provide a program 56 for execution. The ALU 70 will fetch and operate on data from memory blocks 62 in accordance with microinstructions of that post-process program 56. The ALU 70 holds control information, such as the size of the cache 62, as well as pointers to structures in the ISU 72 and to specific blocks within the cache 62.

Memory cache 62 contains memory resources that the manager program 58 allocates and frees at the request of a post-processing program 56. The memory in the cache 62 is organized into blocks. Each block normally comprises a number of data words. The blocks may further contain fields indicative of memory size. When a specific block is needed from the cache 62, the post-processing algorithm 56 accesses the block using an identifier. At the conclusion of the post-processing operation, the protocol program may format the recombinant signal according to the packet header block to ensure compatibility with an applicable audio standard. The DSP 60 may then output the formatted signal at block 52 (FIG. 4) to a digital-to-analog converter 76.

It should be apparent that many variations of the above illustrated embodiment may be implemented without departing from the scope of the present invention. For instance the memory manager program may reside within the DSP for logistical considerations. Another embodiment may utilize external memory, such as memory resident on the host processor. Such a configuration may implement a least recently used (LRU) algorithm in the DSP for controlling the transfer of memory blocks. The LRU algorithm may assure that only the most frequently used blocks of data are stored in DSP memory. Further, if a block of data not in the DSP memory is required, the needed block replaces the block in the memory that is least recently used. Processor hardware for implementing an LRU algorithm, including the transfer of data blocks between the main memory and cache memory, is well-known in the art.

As an alternative to searching bit maps, linked lists may be used for linking available free memory from one block to the next block. Various algorithms may determine which block to allocate in order to meet a storage request. A "garbage collection" process may likewise collect unused memory blocks and return them to a free memory list. Furthermore, it should be apparent that any size or combination of memory blocks can be used in accordance with the present invention. The theoretical minimum size for the data blocks is, of course, one byte or word per block.

While the present invention has been illustrated by a description of various embodiments and while these embodiments have been described in considerable detail, it is not the intention of the applicants to restrict or in any way limit the scope of the appended claims to such detail. Additional advantages and modifications will readily appear to those skilled in the art. The invention in its broader aspects is therefore not limited to the specific details, representative apparatus and method, and illustrative example shown and described. Accordingly, departures may be made from such details without departing from the spirit or scope of applicant's general inventive concept.

What is claimed is:

1. A method of managing memory resources within an audio playback system, wherein the resources comprise memory blocks, the method comprising:

identifying a first and a second audio process, wherein the first and the second audio processes execute at different times;

allocating a first memory block to the first and the second processes;

associating a first audio frame with the first process;

associating a second audio frame with the second process;

buffering the first audio frame to the first memory block; and switching between the first and second processes at a boundary of the first frame.

2. The method according to claim 1, further comprising resetting a memory area of the first memory block to zero prior to receiving the second audio frame.

3. The method according to claim 1, further comprising identifying the first audio frame.

4. The method according to claim 1, further comprising processing the first audio frame.

5. The method according to claim 1, further comprising implementing program code to ensure that the first and the second audio processes run at different times.

6. The method according to claim 1, further comprising outputting the first audio frame.

7. The method according to claim 1, further comprising formatting the first audio frame.

8. The method according to claim 1, further comprising muting volume parameters associated with the first memory block during the step of switching between the first and second processes.

9. An apparatus for managing memory within an audio playback system, comprising:

a memory area comprising a plurality of blocks;

program storage storing a program configured to allocate a first memory block from among the plurality of blocks to a first and a second audio process, wherein the first and the second processes execute at different times; and a processor operable to execute the program, wherein the processor further buffers a first audio frame associated with the first process and a second audio frame associated with the second process to the memory block according to a protocol of the program, wherein the processor is further configured to allow switching between the first and second processes at a boundary of the first frame.

10. The apparatus of claim 9, wherein the program is configured to identify the first audio frame.

11. The apparatus of claim 9, wherein the program is configured to associate the first frame with the first audio process.

12. The apparatus of claim 9, wherein the program is configured to initiate processing of the first frame.

13. The apparatus of claim 9, wherein the program is configured to ensure that the first and the second audio processes run at different times.

14. The apparatus of claim 9, wherein the program is configured to initiate output of the first audio frame.

15. The apparatus of claim 9, wherein the program is configured to initiate formatting of the first audio frame.

16. The apparatus of claim 9, wherein the program is configured to reset a memory area of the first memory block to zero.

17. The apparatus of claim 9, wherein the program is configured to mute volume parameters associated with the first memory block while switching between the first and second processes.

18. A program product, comprising:

a program configured to manage memory resources within an audio playback system, wherein the resources comprise memory blocks, wherein the program is further configured to identify a first and a second audio process, wherein the first and second audio processes execute at different times; wherein the program allocates a first memory block to the first and second processes, associates a first audio frame with the first process and second audio frame with the second process, buffers the first audio frame to the first memory block, and allows switching between the first and second processes at a boundary of the first frame; and a signal bearing medium bearing the program.

19. The program product of claim 18, wherein the signal bearing medium includes a recordable medium.

20. The program product of claim 18, wherein the signal bearing medium includes a transmission type medium.

* * * * *